US009242463B2

(12) United States Patent
Munakata et al.

(10) Patent No.: US 9,242,463 B2
(45) Date of Patent: Jan. 26, 2016

(54) LIQUID-JET HEAD AND LIQUID-JET APPARATUS

(71) Applicants: SEIKO EPSON CORPORATION, Tokyo (JP); NGK INSULATORS, LTD., Nagoya-shi, Aichi (JP)

(72) Inventors: Manabu Munakata, Matsumoto (JP); Hajime Nakao, Azumino (JP); Takaaki Koizumi, Tajimi (JP); Masato Komazawa, Nagoya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/226,628

(22) Filed: Mar. 26, 2014

(65) Prior Publication Data

US 2014/0362138 A1 Dec. 11, 2014

(30) Foreign Application Priority Data

Mar. 28, 2013 (JP) ..... 2013-070482

(51) Int. Cl.

| | |
|---|---|
| ***B41J 2/16*** | (2006.01) |
| ***B41J 2/14*** | (2006.01) |
| *B41J 2/165* | (2006.01) |

(52) U.S. Cl.

CPC ..... *B41J 2/14233* (2013.01); *B41J 2/16508* (2013.01); *B41J 2002/14419* (2013.01)

(58) Field of Classification Search

CPC ..... B41J 2/1433; B41J 2002/14475; B41J 2002/14419; B41J 2/175; B41J 2/145

See application file for complete search history.

(56) References Cited

U.S. PATENT DOCUMENTS

| | | | | |
|---|---|---|---|---|
| 8,123,337 | B2 * | 2/2012 | Drury et al. | 347/69 |
| 8,282,187 | B2 * | 10/2012 | Iwanaga | 347/29 |
| 2006/0158480 | A1 | 7/2006 | Ito | |

FOREIGN PATENT DOCUMENTS

| | | | |
|---|---|---|---|
| JP | 2006-198812 | A | 8/2006 |

* cited by examiner

*Primary Examiner* — Lamson Nguyen
(74) *Attorney, Agent, or Firm* — Maschoff Brennan

(57) ABSTRACT

A liquid-jet head includes: a plurality of individual passages communicating with nozzle orifices that jet liquid; a manifold communicating with the plurality of individual passages, in which a surface of the manifold on the liquid-jetting face side is sealed with a sealing member; and a rib provided in the manifold on the sealing member side.

12 Claims, 8 Drawing Sheets

A-A'

B-B'

A-A'

B-B'

A-A'

B-B'

LIQUID-JET HEAD AND LIQUID-JET APPARATUS

The entire disclosure of Japanese Patent Application No. 2013-070482 filed Mar. 28, 2013 is expressly incorporated by reference herein.

BACKGROUND

1. Technical Field

The invention relates to a liquid-jet head and a liquid-jet apparatus that jet a liquid from nozzle orifices, and particularly relates to an inkjet recording head and an inkjet recording apparatus that eject ink as the liquid.

2. Related Art

A liquid-jet head includes: a plurality of individual passages communicating with nozzle orifices; and a manifold communicating with the individual passages. After a liquid is filled into the inside from the manifold to the nozzle orifices, a pressure generator such as a piezoelectric actuator provided in each of the individual passages generates pressure change in the liquid inside the individual passage to jet the liquid from the nozzle orifice.

In the case of such a liquid-jet head, a suction cap is brought into contact with a liquid-jetting face in which the nozzle orifices are open, and cleaning is performed by using the suction cap to discharge the ink inside the individual passages and the manifold through the nozzle orifices to the outside.

However, when a cap member is brought into contact with the liquid-jetting face in a region where the manifold is provided in the liquid-jet head, this brings about a problem that a sealing member, such as a nozzle plate, that seals the liquid-jetting face side of the manifold is deformed.

For this reason, a liquid-jet head in which a cap member is configured to be brought into contact with a liquid-jetting face on an outer side of a manifold has been proposed (see for example JP-A-2006-198812)

However, when the cap member is configured to be brought into contact with the liquid-jetting face on the outer side of the manifold as in JP-A-2006-198812, there is a problem that the cap member is increased in size and also the liquid-jet head is increased in size.

SUMMARY

An advantage of some aspects of the invention is to provide a liquid-jet head and a liquid-jet apparatus that can suppress deformation of the liquid-jetting face side of a manifold and also can be decreased in size.

A first aspect of the invention is a liquid-jet head including a plurality of individual passages, a manifold, and a rib. The individual passages communicate with nozzle orifices that jet liquid. The manifold communicates with the individual passages, and a surface of the manifold on the liquid-jetting face side is sealed with a sealing member. The rib is provided in the manifold on the sealing member side.

According to the first aspect, the sealing member can be supported with the rib. Accordingly, when an external pressure is applied to the sealing member, deformation of the sealing member can be suppressed. Therefore, the cap member can be brought into contact with the region where the manifold is formed, there is no need to provide a region where the cap member is brought into contact, outside the manifold, and the size of the liquid-jet head can be reduced.

Here, it is preferable that the rib be extended in a second direction that is orthogonal to a first direction in which the nozzle orifices are provided in parallel, and a plurality of the ribs be provided in parallel in the first direction. Accordingly, since the rib is extended in the second direction, it is possible to align the flow line (the velocity vector) of the ink with the bubble discharge direction, near a region where the manifold and the individual passages communicate with each other. Moreover, the plurality of ribs make it possible to further securely suppress deformation of the sealing member.

In addition, it is preferable that the manifold include: a first manifold portion provided on the sealing member side; and a second manifold portion provided on an opposite side from the sealing member, a surface of the first manifold portion on an opposite side from the sealing member is defined by a beam portion, and each of the ribs is provided in the first manifold portion at such a height that the rib reaches from the sealing member to the beam portion. Accordingly, since the rib is extended to the beam portion, the sealing member is supported by beam portion with the rib, making it possible to further suppress deformation of the sealing member.

In addition, it is preferable that the sealing member be a nozzle plate in which the nozzle orifices are formed. According to this, it is possible to reduce the number of parts and the costs, and reduce the height of the liquid-jet head.

Further, a second aspect of the invention is a liquid-jet apparatus including the liquid-jet head of the first aspect. According to the second aspect, a liquid-jet apparatus being capable of preventing leakage of a liquid and being reduced in size can be achieved.

In addition, it is preferable that the liquid-jet apparatus further include: a cap member that comes into contact with the liquid-jetting face of the liquid-jet head, in which the cap member have such a size that the cap member comes into contact with a region in which the manifold is formed in the liquid-jet head. According to this, the cap member can be reduced in size, and the liquid-jet apparatus can thus be reduced in size.

DESCRIPTION OF EXEMPLARY EMBODIMENTS

Detailed description will be provided below for the invention on the basis of embodiment.

Embodiment 1

Figure 1:
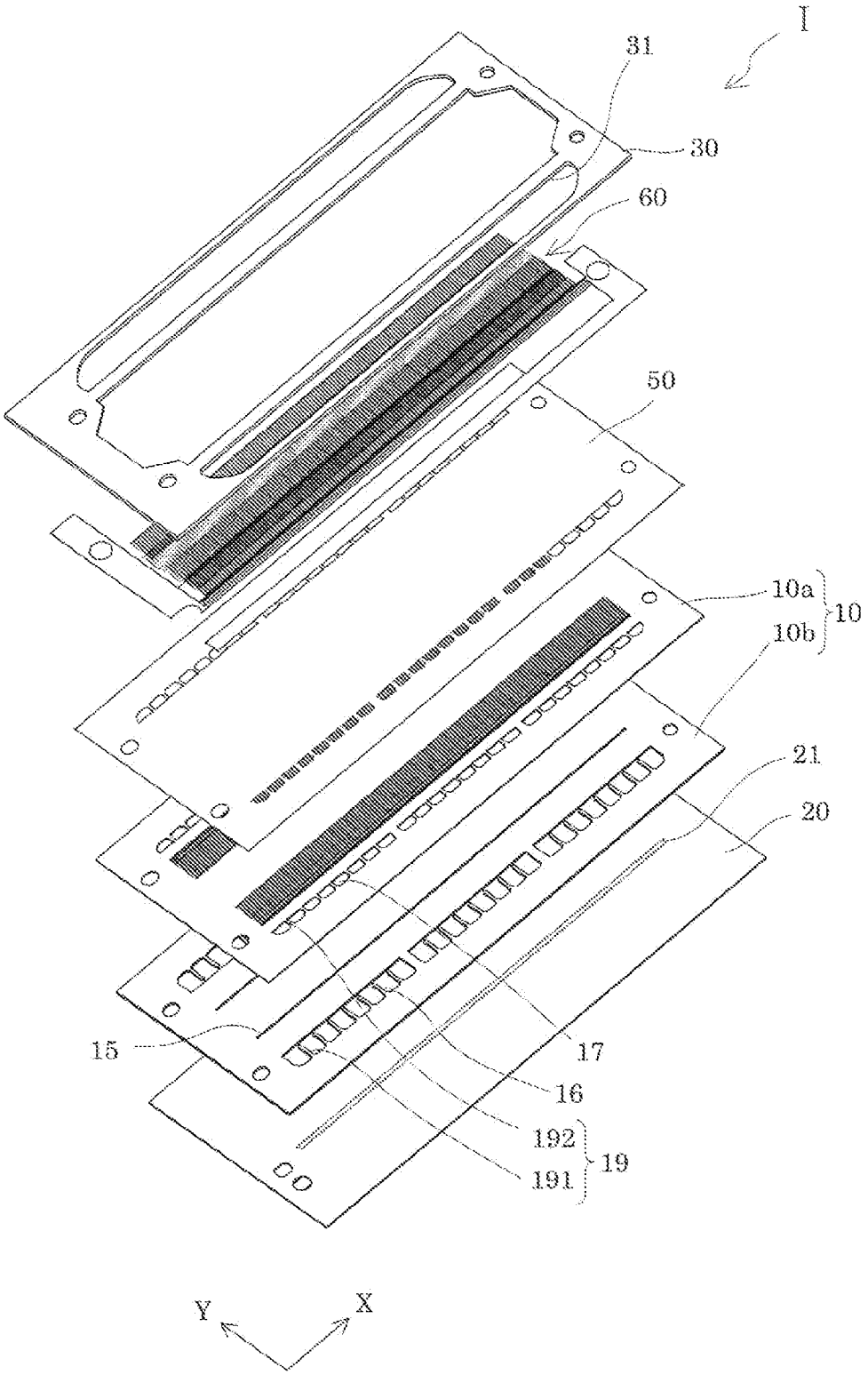
FIG. 1 is an exploded, perspective view of a recording head according to Embodiment 1 of the invention.
Figure 2:
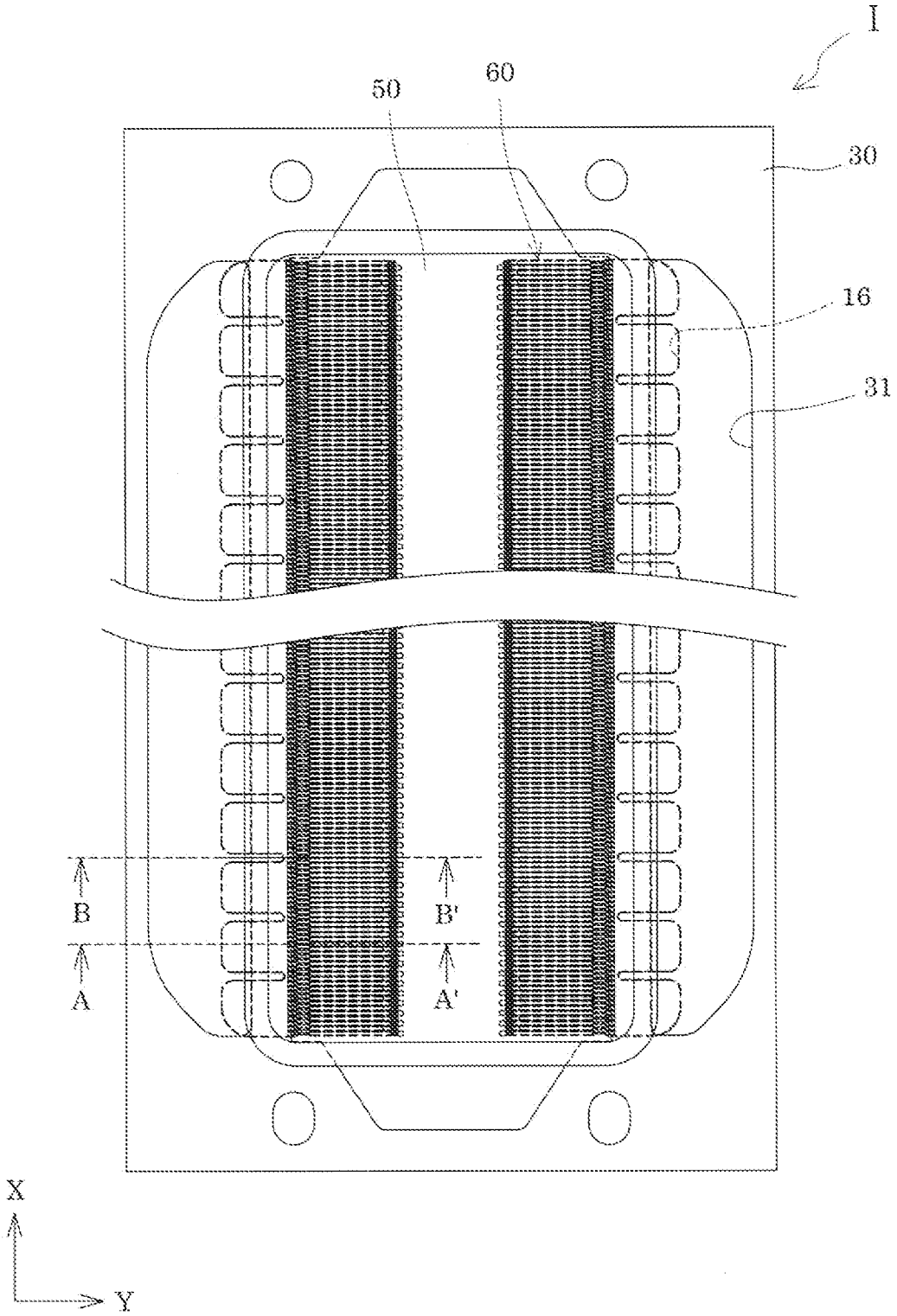
FIG. 2 is a plan view of the recording head according to Embodiment 1 of the invention.
Figure 3A:
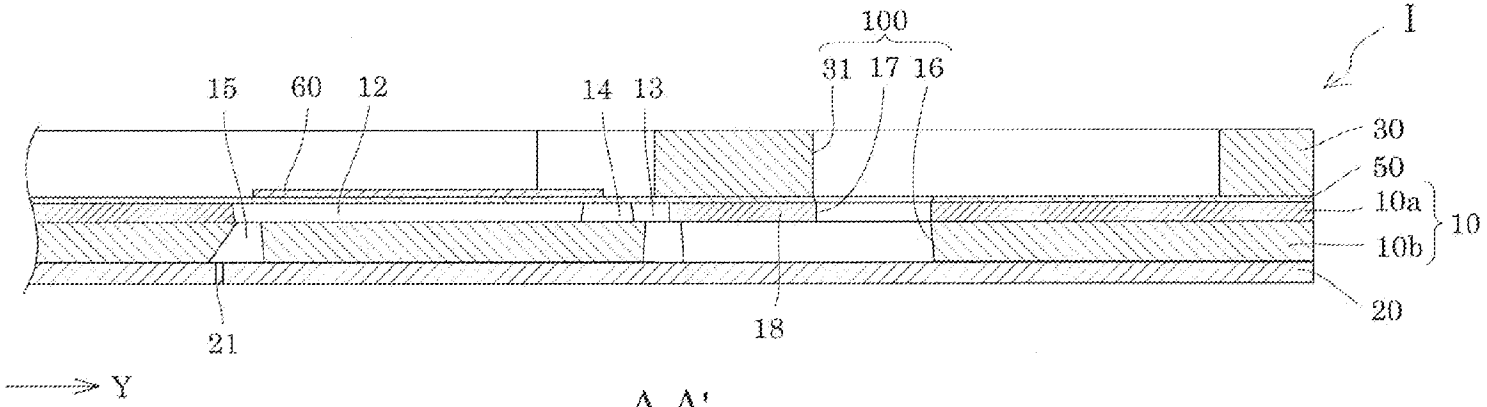
FIG. 3A is a cross-sectional view of the recording head according to Embodiment 1 of the invention.
Figure 3B:
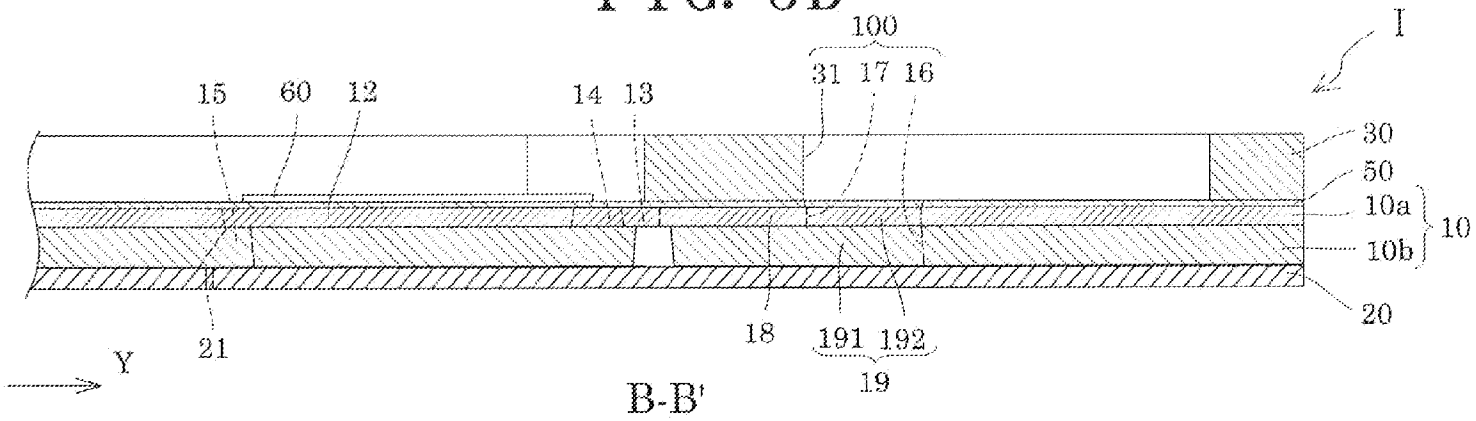
FIG. 3B is another cross-sectional view of the recording head according to Embodiment 1 of the invention.

FIG. 1 is an exploded, perspective view of an inkjet recording head showing an example of a liquid-jet head according to Embodiment 1 of the invention. FIG. 2 is a plan view of the inkjet recording head. FIG. 3A is a cross-sectional view taken along the line A-A' in FIG. 2, and FIG. 3B is a cross-sectional view taken along the line B-B' in FIG. 2.

As shown in the figures, a passage forming substrate 10 constituting an inkjet recording head I is formed by laminating a first passage forming substrate 10*a* and a second passage forming substrate 10*b* in Embodiment 1. Although the passage forming substrate 10 is shown as the first passage forming substrate 10*a* and the second passage forming substrate 10*b* in Embodiment 1, these substrates may be an integrally-formed single substrate. The passage forming substrate 10 (the first passage forming substrate 10*a* and the second passage forming substrate 10*b*) is formed from a ceramic plate of alumina ($Al_2O_3$), zirconia ($ZrO_2$), or the like, for example.

In the passage forming substrate 10 (the first passage forming substrate 10*a*), pressure generating chambers 12 are provided in parallel in a direction in which a plurality of nozzle orifices 21 that eject ink of the same color are provided in parallel. Hereinafter, this direction is referred to as a parallel direction of the pressure generating chambers 12 or a first direction X. The passage forming substrate 10 (the first passage forming substrate 10*a*) is provided with a plurality of rows, two rows in Embodiment 1, in each of which the pressure generating chambers 12 are provided in parallel in the first direction X. Hereinafter, the direction in which the rows of the pressure generating chambers 12 are provided in parallel is referred to as a second direction Y. Note that in Embodiment 1, the pressure generating chambers 12 provided in parallel in the first direction X in each row are arranged in such a manner as to be alternately displaced slightly in the second direction Y.

Moreover, ink supply paths 14 and communicating paths 13 are provided in the passage forming substrate 10 (the first passage forming substrate 10*a*) on one end side of the pressure generating chambers 12 in the second direction Y.

Each of the ink supply paths 14 is provided in such a manner as to have a width smaller than that of each of the pressure generating chambers 12 in the first direction X, thereby generating a certain passage resistance. Note that the width of the ink supply paths 14 in the first direction X is reduced in Embodiment 1, the invention is not limited particularly to this, and the depth (in the lamination direction of the passage forming substrate 10 and a nozzle plate 20) may be reduced. Moreover, a plurality of the ink supply paths 14 may be provided such that the cross-sectional area of the opening of each ink supply path 14 is decreased.

Each communicating path 13 is formed with substantially the same width as that of each pressure generating chamber 12 in the first direction X. In other words, the opening area of the communicating path 13 (the opening area along the first direction X) is the same as that of the pressure generating chamber 12. A plurality of sets of the pressure generating chambers 12, the communicating paths 13, and the ink supply paths 14 are divided by partition walls and arranged in the first direction X.

In addition, nozzle communicating holes 15 are provided in the pressure generating chambers 12 of the passage forming substrate 10 on the opposite side from the ink supply paths 14 in the second direction Y. The nozzle communicating holes 15 penetrate the passage forming substrate 10 (the second passage forming substrate 10*b*) in the thickness direction. The nozzle communicating holes 15 allow the pressure generating chambers 12 and nozzle orifices 21, which will be described in later, to communicate with each other.

In this manner, the passage forming substrate 10 of Embodiment 1 is provided with individual passages each including the pressure generating chamber 12, the communicating path 13, the ink supply path 14, and the nozzle communicating hole 15.

Further, the passage forming substrate 10 is provided with first manifold portions 16 and second manifold portions 17 constituting a part of a manifold 100 communicating with the pressure generating chambers 12 through the ink supply paths 14 and the communicating paths 13.

The first manifold portion 16 is provided in such a manner as to penetrate the second passage forming substrate 10*b* in the thickness direction (the lamination direction of the first passage forming substrate 10*a* and the second passage forming substrate 10*b*), and communicates with the communicating path 13.

In addition, the second manifold portion 17 is provided in such a manner as to penetrate the first passage forming substrate 10*a* in the thickness direction and to communicate with the first manifold portion 16. In Embodiment 1, the second manifold portion 17 and the communicating path 13 are defined by a beam portion 18 provided therebetween. The second manifold portion 17 does not communicate with the communicating paths 13 directly, but communicates with the communicating paths 13 through the first manifold portion 16.

These first manifold portion 16 and second manifold portion 17 are provided continuously in the first direction X across the plurality of pressure generating chambers 12 provided in parallel in the first direction X, and constitute a part of the manifold 100 communicating commonly with the plurality of pressure generating chambers 12.

In addition, ribs 19 are provided in the first manifold portion 16 and the second manifold portion 17. The ribs 19 include first ribs 191 provided in the first manifold portion 16 and second ribs 192 provided in the second manifold portion 17.

The first ribs 191 are extended in the second direction Y in the first manifold portion 16. A plurality of the first ribs 191 are provided in parallel at predetermined intervals in the first direction X in the first manifold portion 16.

In Embodiment 1, as shown in FIG. 3B, the first ribs 191 are provided in the first manifold portion 16 in such a manner as to extend from a wall surface on the opposite side from the communicating paths 13 in the second direction Y toward a wall surface on the communicating paths 13 side, and are formed with predetermined spaces formed in regions communicating with the communicating paths 13. In other words, in the first manifold portion 16, the first ribs 191 are not provided in the regions communicating with the communicating paths 13, so that spaces communicating continuously in the second direction Y are defined.

The first ribs 191 are provided across the depth of the first manifold portion 16 (in the lamination direction of the first passage forming substrate 10*a* and the second passage forming substrate 10*b*). In other words, the first manifold portion 16 has one opening sealed by the nozzle plate 20, which is a sealing member described later in detail, the first ribs 191 are formed to have a height reaching from the nozzle plate 20 side to the beam portion 18.

On the other hand, the second ribs 192 are provided in the second manifold portion 17 at predetermined intervals with the same pitch as the first ribs 191 in the first direction X. In addition, the second ribs 192 are provided in the second manifold portion 17 in such a manner as to extend in the second direction Y, so that the second manifold portion 17 is partitioned into a plurality of spaces in the first direction X by the second ribs 192.

Note that although in Embodiment 1, the ribs 19 are constituted of the first ribs 191 and the second ribs 192, the invention is not limited to this configuration, and the ribs 19 may be constituted of only the first ribs 191, for example.

The nozzle plate 20 provided with the nozzle orifices 21 is joined to a surface of the passage forming substrate 10 on the first manifold portion 16 side. The nozzle plate 20 is made of a plate-shaped member formed from a metal material such as stainless steel (SUS) or a ceramic material such as silicon. The nozzle orifices 21 are formed in the nozzle plate 20 with the same arrangement pitch as the pressure generating chambers 12. Specifically, four rows in each of which the nozzle orifices 21 are provided in parallel in the first direction X are provided in parallel in the second direction Y. In other words, two rows in each of which the nozzle orifices 21 are provided in parallel in the first direction X are provided in parallel in the second direction Y for each row in which the pressure generating chambers 12 are provided in parallel in the first direction X. The two rows in each of which the nozzle orifices 21 are provided in parallel in the second direction Y are arranged at positions displaced from each other by half of the pitch of the nozzle orifices 21 in the first direction X.

The nozzle plate 20 seals the liquid-jetting face side of the first manifold portions 16. Accordingly, in Embodiment 1, the nozzle plate 20 functions as a sealing member that seals the manifold 100. Note that the sealing member is not limited to the nozzle plate 20, and for example, the first manifold portions 16 may be sealed with a sealing member other than the nozzle plate 20 while the nozzle plate 20 is provided with such a small area that the nozzle plate 20 does not overlap a region where the first manifold portions 16 are formed. Alternatively, a plate-shaped sealing member may be provided between the nozzle plate 20 and the passage forming substrate 10 such that the first manifold portions 16 are sealed with the sealing member. In this case, it is only necessary to provide the sealing member with communicating paths that allow the nozzle communicating holes 15 and the nozzle orifices 21 to communicate with each other.

In addition, a vibration plate 50 and piezoelectric actuators 60 are provided on passage forming substrate 10 on the opposite side from the nozzle plate 20.

The vibration plate 50 is made of an inorganic film of a ceramic such as zirconia, alumina, or the like, silicon oxide, or the like, or a thin plate of stainless steel (SUS) or the like. One surface of the pressure generating chambers 12, the ink supply paths 14, and the communicating paths 13 is sealed with the vibration plate 50.

In addition, the piezoelectric actuators 60 are provided on the vibration plate 50 in regions facing the respective pressure generating chambers 12. Here, although not particularly shown, each of the piezoelectric actuators 60 is formed by sandwiching a piezoelectric layer made of a piezoelectric material with two electrodes. The lamination direction of the two electrodes and the piezoelectric material may be the same as the lamination direction of the passage forming substrate 10 and the nozzle plate 20, or as a surface direction of the vibration plate 50, i.e., the first direction X and the second direction Y. Alternatively, a plurality of the piezoelectric layers sandwiched with two electrodes may be laminated.

Such a piezoelectric layer may be formed by attaching or printing a green sheet made of a piezoelectric material, for example. Moreover, the two electrodes and the piezoelectric layer may be formed by a film formation method, a lithography method, and the like.

In addition, a manifold plate 30 is provided on the passage forming substrate 10 on the piezoelectric actuators 60 side. Third manifold portions 31 are provided in the manifold plate 30. The third manifold portions 31 communicate with the second manifold portions 17 of the passage forming substrate 10 to constitute a part of the manifold 100. In other words, the manifold 100 in Embodiment 1 is constituted of the first manifold portions 16 and the second manifold portions 17 provided in the passage forming substrate 10 and the third manifold portions 31 provided in the manifold plate 30.

The passage forming substrate 10 is formed as follows by using two of the first passage forming substrate **10*a* and the second passage forming substrate 10*b*, each formed by shaping a clay-like ceramic material, a so-called green sheet, into a predetermined thickness. Specifically, the pressure generating chambers 12 and the like are drilled in the first passage forming substrate 10*a* while the first manifold portions 16, the nozzle communicating holes 15, and the like are drilled in the second passage forming substrate 10*b*. Thereafter, the first passage forming substrate 10*a*, the second passage forming substrate 10*b*, and the vibration plate 50 are laminated and baked to thus be integrated with no need of any adhesive agent. Note that the vibration plate 50 may be joined after the passage forming substrate 10 is baked, depending on the material of the vibration plate 50. Thereafter, the piezoelectric actuators 60 are formed on the vibration plate 50**.

In the inkjet recording head I having the above-described configuration, ink is first taken into the manifold 100 from an ink cartridge (a storage unit) to fill the passages from the manifold 100 to the nozzle orifices 21 with the ink. Thereafter, in accordance with a recording signal from an unillustrated drive circuit, voltage is applied to each of the piezoelectric actuators 60 corresponding to the respective pressure generating chambers 12 to thereby flexurally deform the vibration plate 50 together with the piezoelectric actuator 60. As a result, the pressure inside the pressure generating chamber 12 is increased to eject an ink droplet from the nozzle orifice 21.

Not that although not particularly shown, a surface of the manifold plate 30 on the opposite side from the passage forming substrate 10 is sealed with a compliance plate provided with flexible compliance portions, or the like. The ink is supplied from the storage unit such as an ink cartridge through this sealed surface.

As described above, in Embodiment 1, the ribs 19 are provided in the manifold 100 on the nozzle plate 20, which is the sealing member, side, so that the nozzle plate 20 is supported by the ribs 19. In particular, the nozzle plate 20 is supported by the beam portion 18 with the first ribs 191 by providing the first ribs 191 such that the first ribs 191 extend from the opening of the first manifold portion 16 on the liquid-jetting face side to the beam portion 18. Accordingly, when a pressure is applied to the nozzle plate 20 from the liquid-jetting face side where the nozzle orifices 21 in the nozzle plate 20 are open to eject ink droplets, deformation of the nozzle plate 20 can be suppressed. Incidentally, if the nozzle plate 20 is deformed by an external pressure, a gap is formed between the nozzle plate 20 and the passage forming substrate 10. Then, there occur failures that the ink is leaked from the gap, that the direction of the openings of the nozzle orifices 21 is changed by the deformation of the nozzle plate 20 to displace the landing positions of ink droplets, and the like. In Embodiment 1, since the ribs 19 are provided, it is possible to suppress deformation of the nozzle plate 20, and to thus suppress occurrence of the leakage of the ink, displacement of the landing positions of the ink droplets, and the like.

It is conceivable that the ribs 19 are provided for the respective individual passages and the first manifold portion 16 is substantially included in the individual passages. However, if the first manifold portion 16 is formed substantially as parts of the individual passages, the capacity of the manifold 100 cannot be secured. In Embodiment 1, since the ribs 19 are provided such that the plurality of individual passages communicate commonly with the first manifold portion 16, the capacity of the manifold 100 can be secured.

Moreover, it is also conceivable that a reinforcement member that reinforces the nozzle plate 20 is separately provided between the nozzle plate 20 and the passage forming substrate 10. However, this increases the number of parts and the cost, and also increases the height of the inkjet recording head I (the height of the passage forming substrate 10 and the nozzle plate 20 in the lamination direction). In Embodiment 1, sealing the manifold 100 of the passage forming substrate 10 with the nozzle plate 20 makes it possible to reduce the number of parts and the cost, and to reduce the height of the inkjet recording head I. In addition, providing the ribs 19 makes it possible to support the region where the manifold 100 is sealed, which is a relatively wide space in the nozzle plate 20, and to thus suppress deformation of the nozzle plate 20.

Here, an inkjet recording apparatus, which is an example of a liquid-jet apparatus including the inkjet recording head I as described above, will be described. Note that FIG. 4 is a schematic perspective view of the inkjet recording apparatus.

Figure 4:
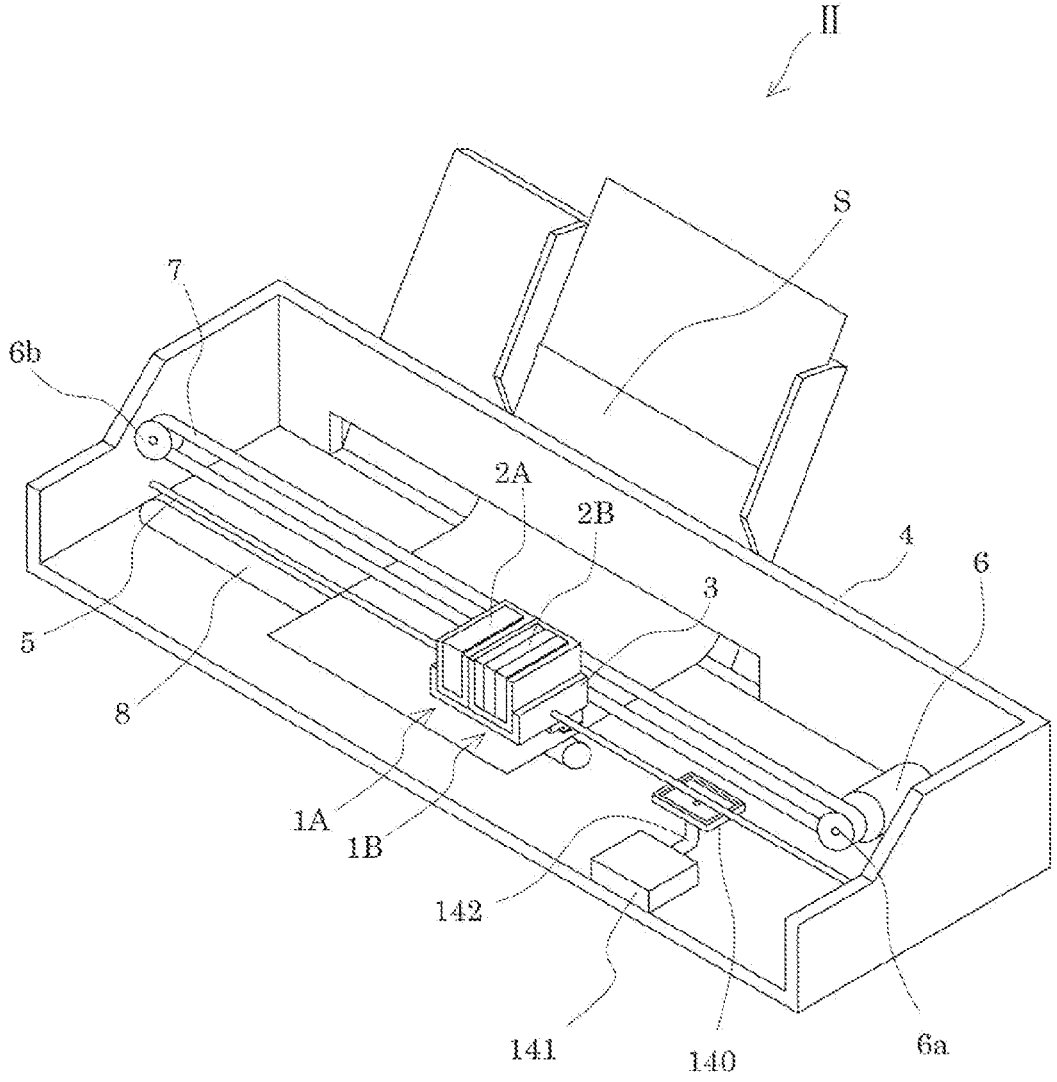
FIG. 4 is a schematic view of a recording apparatus according to Embodiment 1 of the invention.

As shown in FIG. 4, an inkjet recording apparatus II includes recording head units 1A and 1B each having the inkjet recording head I. The recording head units 1A and 1B are provided detachably with cartridges 2A and 2B, each constituting an ink supply unit. The recording head units 1A and 1B are mounted on a carriage 3, and the carriage 3 is provided on a carriage shaft 5 attached to an apparatus main body 4 such that the carriage 3 is movable in an axial direction of the carriage shaft 5. The recording head units 1A and 1B eject a black ink composition and a color ink composition, respectively, for example.

Then, drive force of a drive motor 6 is transmitted to the carriage 3 through a plurality of unillustrated gears and a timing belt 7, thereby moving the carriage 3 with the head units 1A and 1B mounted thereon along the carriage shaft 5. On the other hand, in the apparatus main body 4, a platen 8 is provided along the carriage shaft 5. A recording sheet S, which is a recording medium such as paper, fed by an unillustrated feeder roller or the like, is wound up and transported by the platen 8.

Moreover, a suction cap 140, which is a cap member that covers the nozzle orifices 21 is provided in a non-printing region of the inkjet recording apparatus II. A suction device 141 such as a vacuum pump, for example, is connected to the suction cap 140 by use of a tube 142. The ink in the passages such as the pressure generating chambers 12 is sucked through the nozzle orifices 21 by using the suction device 141 to suck gas inside the suction cap 140 which is brought into tight contact with the liquid-jetting face.

Figure 5:
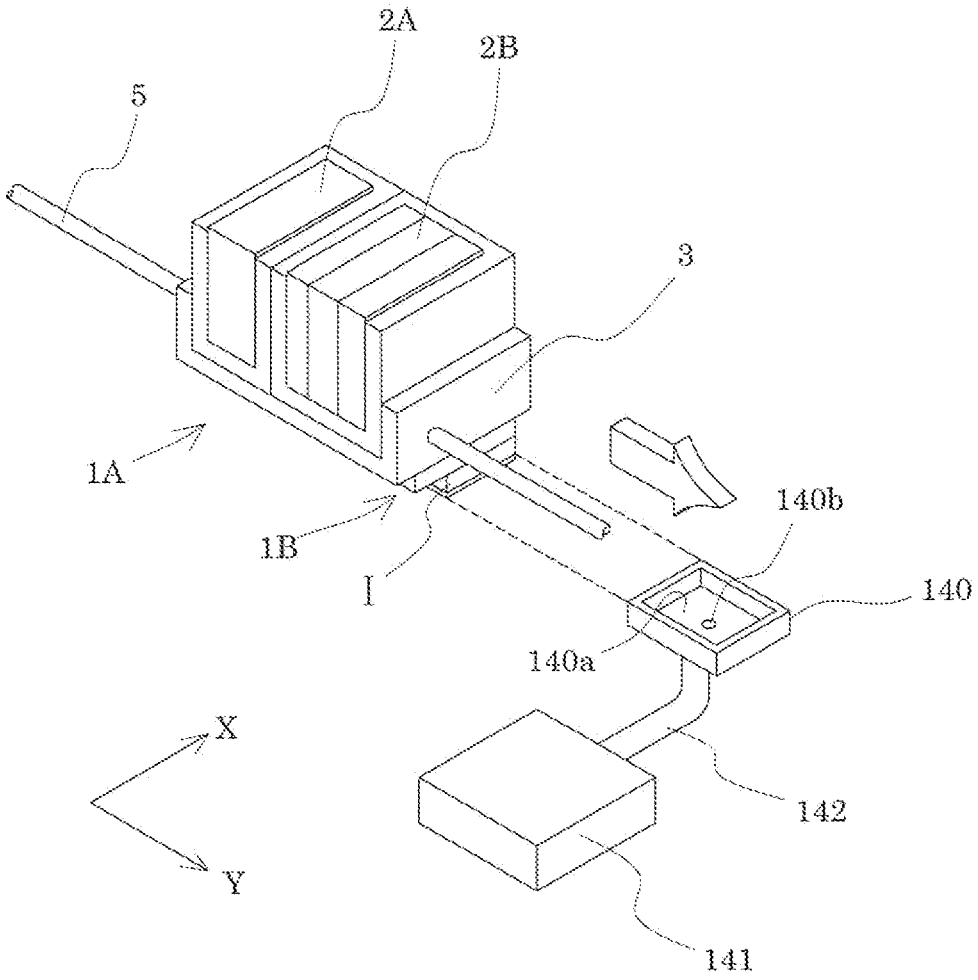
FIG. 5 is a perspective view of a main part of the recording apparatus according to Embodiment 1 of the invention.
Figure 6:
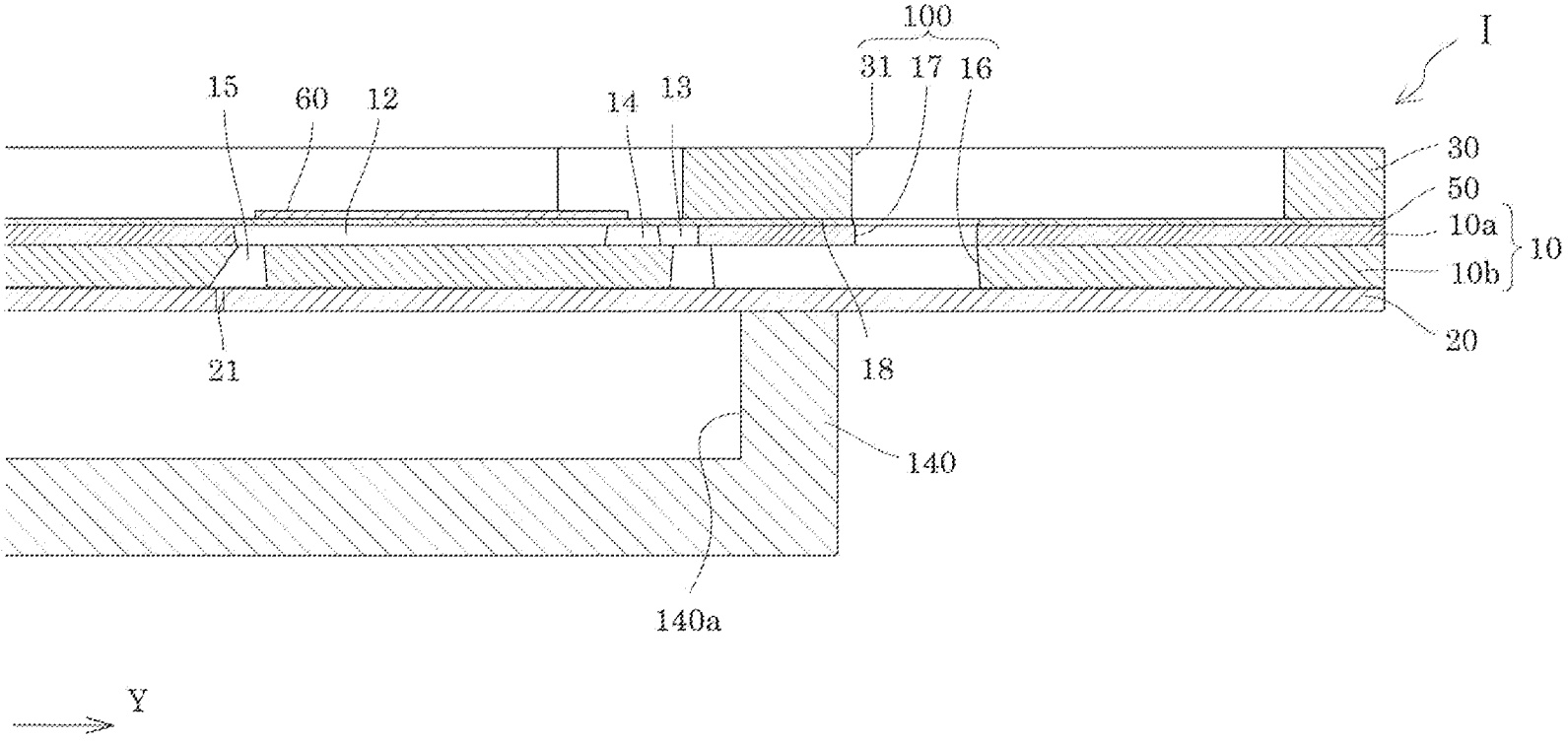
FIG. 6 is a cross-sectional view of the recording head and a suction cap according to Embodiment 1 of the invention.

Here, a suction unit having the suction cap and the suction device will be described with reference to FIGS. 5 and 6. Note that FIG. 5 is a perspective view in which a main part of the inkjet recording apparatus is enlarged, and FIG. 6 is a cross-sectional view in which a of the inkjet recording head and the suction cap is enlarged.

As shown in the figures, the suction cap 140 is provided to mutually face the nozzle plate 20 of the inkjet recording head I, and provided to cover all the plurality of nozzle orifices 21 provided in the nozzle plate 20.

The suction cap 140 has a suction port 140*a* that faces the nozzle plate 20 and is open across all the plurality of nozzle orifices 21. The edge portion of the suction port 140*a* comes into contact with the surface of the nozzle plate 20, so that the suction cap 140 covers all the nozzle orifices 21. In addition, the suction cap 140 has a communicating port 140*b* in a surface thereof on the opposite side from the suction port 140*a*. The communicating port 140*b* communicates with the suction port 140*a*. The suction device 141 is connected to the communicating port 140*b* through the tube 142.

The suction cap 140 is used for suction operation to prevent printing failure due to bubbles and the like in the following manner: The edge portion of the suction port 140*a* comes into contact with the liquid-jetting face, which is the surface of the nozzle plate 20, and the suction device 141 sucks the ink to suck the ink inside the passages such as the pressure generating chambers 12 through the nozzle orifices 21. In addition, the suction cap 140 plays a role of preventing the ink near the nozzle orifices 21 from drying or thickening, by covering all the nozzle orifices 21 without suction operation by the suction device.

The suction cap 140 in Embodiment 1 has such a size that the suction cap 140 comes into contact with the region where the manifold 100 is formed in the inkjet recording head I. In other words, the suction cap 140 has such a size that the suction cap 140 comes into contact with the region where the manifold 100 is sealed (defined) in the liquid-jetting face of the nozzle plate 20 which is the sealing member that seals the manifold 100.

Even when the suction cap 140 is brought into contact with the region facing the manifold 100 as described above, the provision of the ribs in the manifold 100 in Embodiment 1 makes it possible to suppress deformation of the nozzle plate 20 caused by being pressed when the suction cap 140 is brought into contact therewith and separation of the nozzle plate 20 from the passage forming substrate 10. Accordingly, it is possible to suppress destruction of the inkjet recording head I and leakage of the ink. It is also possible to suppress occurrence of displacement of the landing positions of the ink droplets ejected from the nozzle orifices 21 on a recording medium, which would occur when the direction of the nozzle orifices 21 is changed due to deformation of the nozzle plate 20.

Moreover, since the suction cap 140 is brought into contact with the region where the manifold 100 is formed, the size of the suction cap 140 can be reduced as compared to the case where the suction cap 140 is brought into contact with an area outside of the region where the manifold 100 is formed. In addition, since there is no need to separately form a region where the suction cap 140 is brought into contact with the inkjet recording head I, the size of the inkjet recording head I, in particular, the size of the inkjet recording head I in the second direction Y can be reduced.

Note that although in Embodiment 1, the suction cap 140 has been described, the invention is not limited to the suction cap 140, the same effects can be achieved, for example, with a contact cap that comes into contact with the liquid-jetting face to seal the nozzle orifices 21, thereby preventing the ink near the nozzle orifices 21 from drying or thickening. In other words, also when the contact cap is bought into contact with the region where the manifold 100 is formed, it is possible to suppress deformation of the nozzle plate 20. Accordingly, the sizes of the contact cap and the inkjet recording head I can be reduced.

Other Embodiments

Figure 7A:
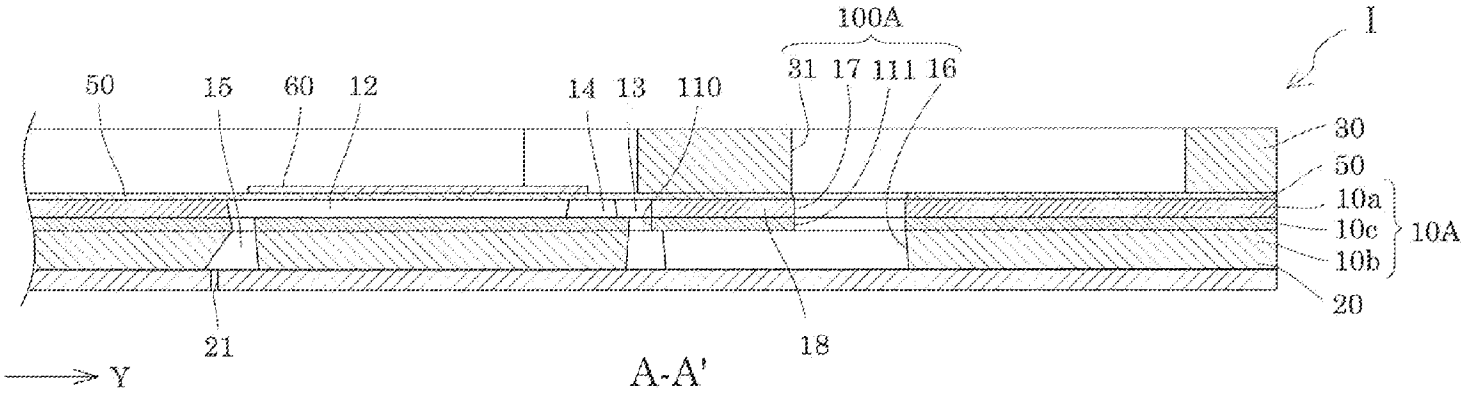
FIG. 7A is a cross-sectional view of a recording head according to another embodiment of the invention.
Figure 7B:
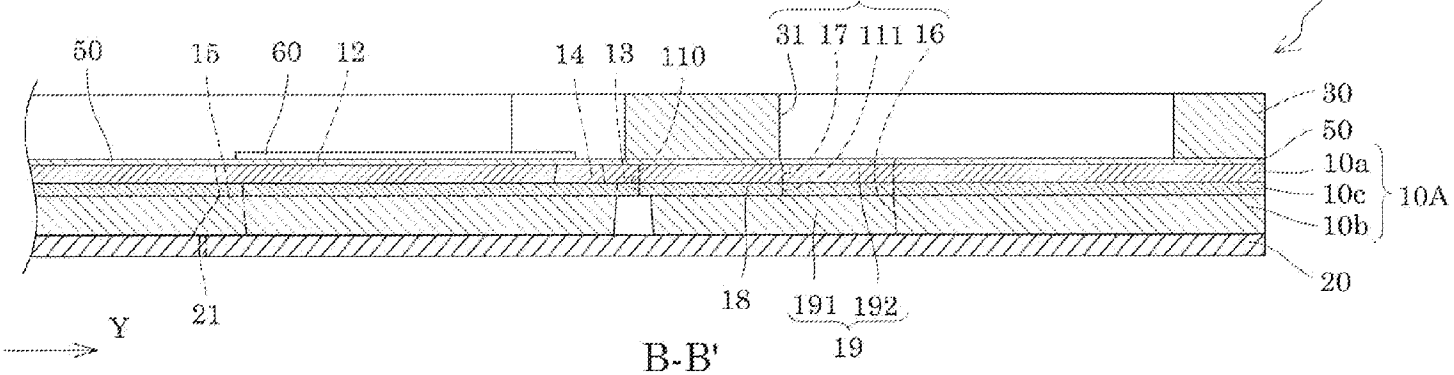
FIG. 7B is another cross-sectional view of a recording head according to another embodiment of the invention.

One embodiment of the invention has been described so far, the essential configuration of the invention is not limited to that described above. For example, in the above-described embodiment, the inkjet recording head in which the communicating paths are provided at the same depth as that of the pressure generating chambers has been described, the invention is not limited to those in terms of the shape of the manifold, the depth of the communicating holes, and the like. Here, another example of the inkjet recording head will be described with reference to FIG. 7. Note that FIG. 7A is a cross-sectional view of an inkjet recording head according to another embodiment of the invention and FIG. 7B is a cross-sectional view of an inkjet recording head according to another embodiment of the invention.

As shown in FIG. 7, an inkjet recording head I includes a passage forming substrate 10A, a nozzle plate 20, a manifold plate 30, a vibration plate 50, and piezoelectric actuators 60.

The passage forming substrate 10A includes a first passage forming substrate 10*a*, a second passage forming substrate 10*b*, and a third passage forming substrate 10*c*. The first passage forming substrate 10*a* is provided on the piezoelectric actuators 60 side. Pressure generating chambers 12, communicating paths 13, and ink supply paths 14 are formed in the first passage forming substrate 10*a*.

In addition, the second passage forming substrate 10*b* is provided on the nozzle plate 20 side. First manifold portions 16, nozzle communicating holes 15, and the like are formed in the second passage forming substrate 10*b*. Moreover, the third passage forming substrate 10*c* is arranged between the first passage forming substrate 10*a* and the second passage forming substrate 10*b*. Connecting paths 110 and fourth manifold portions 111 are provided in the third passage forming substrate 10*c*. The connecting path 110 allows the first manifold portion 16 and the communicating path 13 to communicate with each other, and the fourth manifold portion 111 allows the first manifold portion 16 and the second manifold portion 17 to communicate with each other.

The connecting path 110 may constitute a part of the individual passage, like the communicating path 13, or may be formed continuously along the first direction X to constitute a part of a manifold 100A. In the embodiment, the connecting path 110 is provided for each pressure generating chamber 12, like the communicating path 13.

In addition, the fourth manifold portion 111 is provided with an opening similar to that of the second manifold portion 17 in the embodiment.

Moreover, in the inkjet recording head I shown in FIG. 7, the manifold 100A is constituted of the first manifold portion 16, the second manifold portion 17, the third manifold portion 31, and the fourth manifold portion 111.

In addition, ribs 19 are provided in the first manifold portion 16, the second manifold portion 17, and the fourth manifold portion 111. The ribs 19 are formed to pass from the first manifold portion 16 through the fourth manifold portion 111 to reach an opening of the second manifold portion 17 on the piezoelectric actuators 60 side.

The passage forming substrate 10A described above may be formed by using three substrates, i.e., the first passage forming substrate 10*a*, the second passage forming substrate 10*b*, and the third passage forming substrate 10*c*, each formed by shaping a clay-like ceramic material, i.e., a so-called green sheet, into a predetermined thickness. Specifically, the pressure generating chamber 12, the second manifold portion 17, and the like are drilled in the first passage forming substrate 10*a*. The first manifold portion 16, the nozzle communicating hole 15, and the like are drilled in the second passage forming substrate 10*b*. The connecting path 110, the fourth manifold portion 111, and the like are drilled in the third passage forming substrate 10*c*. Thereafter, the first passage forming substrate 10*a*, the second passage forming substrate 10*b*, the third passage forming substrate 10*c*, and the vibration plate 50 are laminated and baked to thus be integrated with no need of any adhesive agent. In other words, although in FIG. 7, the first passage forming substrate 10*a*, the second passage forming substrate 10*b*, and the third passage forming substrate 10*c*, which constitute the passage forming substrate 10A, are shown as separate members, these substrates are actually baked simultaneously together to form a single integrated substrate. Of course, if the first passage forming substrate 10*a*, the second passage forming substrate 10*b*, and the third passage forming substrate 10*c* are laminated after being baked independently, the passage forming substrate 10A including three layers laminated together as shown in FIG. 7 is obtained.

With such configuration as well, even when an external pressure is applied to the liquid-jetting face, deformation of the nozzle plate 20 can be suppressed by the ribs 19.

Figure 8A:
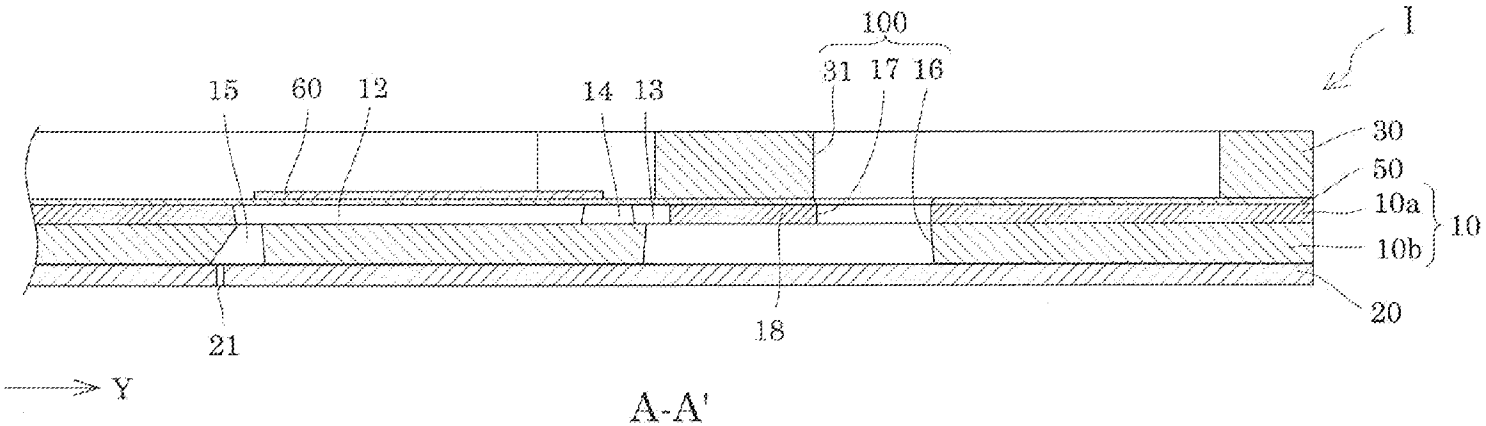
FIG. 8A is a cross-sectional view of a recording head according to still another embodiment of the invention.
Figure 8B:
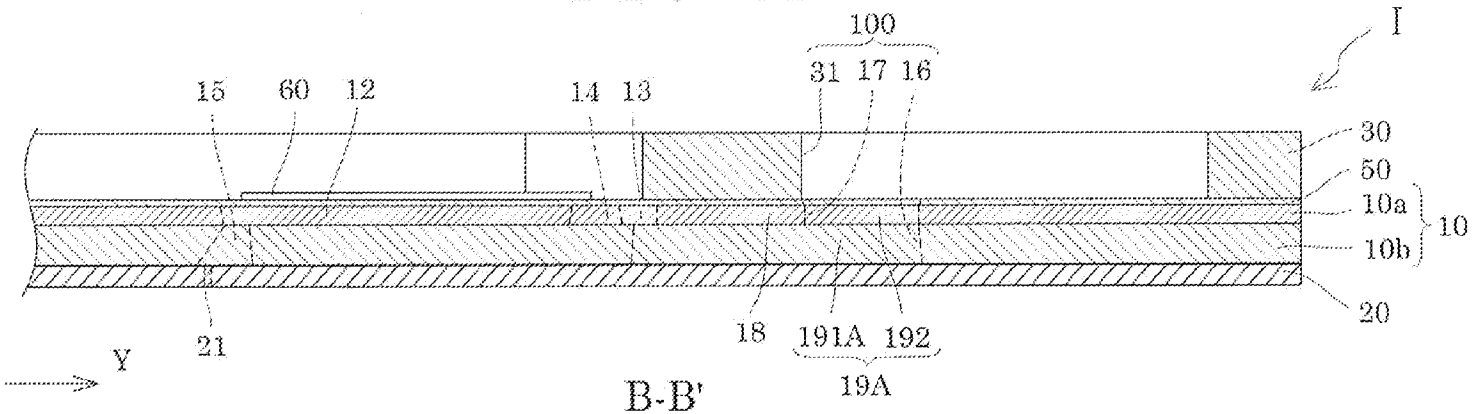
FIG. 8B is another cross-sectional view of a recording head according to still another embodiment of the invention.

In addition, in the above-described embodiment, the first ribs 191, included in the ribs 19, are provided in the first manifold portion 16 in such a manner as to extend from the wall surface on the opposite side from the communicating paths 13 in the second direction Y toward the wall surface on the communicating paths 13 side, and the predetermined spaces are formed between the first ribs 191 and the wall surface on the communicating paths 13 side. However, the invention is not limited to this configuration. Here, another example of the ribs is shown in FIG. 8. Note that FIG. 8A is a cross-sectional view of an inkjet recording head according to still another embodiment of the invention and FIG. 8B is another cross-sectional view of an inkjet recording head according to still another embodiment of the invention.

As shown in FIG. 8, ribs 19A include first ribs 191A and second ribs 192. The first ribs 191A are provide continuously in the second direction Y in a first manifold portion 16. According to such ribs 19A, each of the first ribs 191A, included in the ribs 19A, is fixed at two end portions, so that each of the ribs 19A is in the form of a beam supported at both ends thereof. Accordingly, the rigidity of the ribs 19A can be further enhanced, and deformation of the nozzle plate 20 can be further reduced. Note that the first ribs 191A included in the ribs 19A are arranged between the communicating paths 13. In other words, this is because providing the ribs 19A to face the communicating paths 13 does not allow the communicating paths 13 and the first manifold portion 16 to communicate with each other, or reduces the opening area for the communication. In other words, according to the first ribs 191 of the ribs 19 in Embodiment 1 described above and the like, since the first ribs 191 are not provided in regions communicating with the communicating paths 13, there is no limitation on the positions to form the first ribs 191, and are no changes in dimensions or no changes in design are required for forming the first ribs 191.

Further, although in the above-described embodiment, the ribs 19, 19A extending in the second direction Y are provided in parallel in the first direction X, the invention is not limited to this configuration. For example, the ribs may be provided to extend in the first direction X. In such case as well, deformation of the nozzle plate 20 can be suppressed by the ribs, making it possible to suppress leakage of the ink and displacement of the landing positions of the ink. As a result, the size of the inkjet recording head I and the size of the suction cap 140 can be reduced. In addition, the number of the ribs 19 to be provided may be one or more, no matter in which direction the ribs 19 are provided. However, when the ribs 19, 19A are provided to extend in the second direction Y as in the above-described embodiments, it is possible to align the flow line (the velocity vector) of the ink with the bubble discharge direction, near a region where the manifold 100 and the individual passages (the pressure generating chambers 12 and the like) communicate with each other, i.e., near the communicating paths 13, so that the bubble discharge performance can be enhanced. Specifically, with a structure in which no ribs 19, 19A are provided or with a configuration in which the ribs are provided to extend in the first direction X in which the pressure generating chambers 12 are provided in parallel, the flow line of the ink has a velocity component also in the first direction X. For this reason, when a negative pressure is generated downstream of the nozzles by a pump having the same ability, this requires a longer time for bubble discharge, that is, a large consumption amount of the ink, as compared to the case of the ribs 19, 19A in Embodiment 1 and the like. In other words, providing the ribs 19, 19A such that the ribs 19, 19A extend in the second direction Y makes it possible to enhance the bubble discharge performance and to thus carry out bubble discharge within a shorter period of time, in turn reducing the consumption amount of the ink.

Furthermore, although in the above-described embodiments, the ribs 19, 19A are provided to extend from the opening of the first manifold portion 16 on the nozzle plate 20 side to the opening of the second manifold portion 17 on the piezoelectric actuators 60 side, the invention is not limited to this configuration. The ribs 19, 19A may be provided to extend to a middle of the first manifold portion 16 in the depth direction. In this case as well, if the ribs 19, 19A are provided with base ends thereof set at the opening side which is sealed by the nozzle plate 20, which is the sealing member, the ribs 19, 19A can suppress deformation of the nozzle plate 20.

Moreover, in Embodiment 1 described above, the inkjet recording head I including the piezoelectric actuators 60 is illustrated. However, the pressure generator that generates pressure change in the pressure generating chambers 12 is not limited to the piezoelectric actuators 300. The same effect can be exerted also with inkjet recording heads including: a thin-film piezoelectric actuator which has a piezoelectric material formed by a sol-gel method, a MOD method, a sputtering method, or the like; a vertical vibration piezoelectric element which has layers of a piezoelectric material and an electrode forming material alternately laminated and which expands and contracts in the axial direction; a so-called electrostatic actuator which has a vibration plate and an electrode arranged with a predetermined gap and which controls the vibration of the vibration plate by using electrostatic force; or a heat generating element which is disposed in a pressure generating chamber for ejecting ink droplets from a nozzle orifice by utilizing bubbles generated by the heat generation of the heat generating element.

Note that the above-described embodiments are described by giving the inkjet recording heads as examples of the liquid-jet head; however, the invention is directed widely to the general liquid-jet heads, and can of course be applied also to liquid-jet heads that eject liquids other than ink. Examples of the other liquid-jet heads include various types of recording heads used in image recording apparatuses such as printers, color material-jet heads used for manufacture of color filters of liquid crystal displays and the like, electrode material-jet heads used for forming electrodes in organic EL displays, FEDs (Field Emission Displays), and the like, bioorganic material-jet heads used for manufacturing bio-chips.

The entire disclosure of Japanese Patent Application No. 2013-070482, filed Mar. 28, 2013 is incorporated by reference herein.

The invention claimed is:

1. A liquid-jet head comprising:

a plurality of individual passages communicating with nozzle orifices that jet liquid;

a manifold communicating with the plurality of individual passages, in which a surface of the manifold on the liquid jetting face side is sealed with a sealing member; and a rib provided in the manifold on the sealing member side, wherein the rib is extended in a second direction that is orthogonal to a first direction in which the nozzle orifices are provided in parallel, a plurality of the ribs are provided in parallel in the first direction, a surface of the manifold portion on an opposite side from the sealing member is defined by a beam portion, and wherein each of the ribs is provided in the manifold portion at such a height that the rib reaches from the sealing member to the beam portion.

2. The liquid-jet head according to claim 1, wherein the sealing member is a nozzle plate in which the nozzle orifices are formed.

3. A liquid-jet apparatus comprising:

the liquid-jet head according to claim 1.

4. The liquid-jet apparatus according to claim 3, further comprising:

a cap member that comes into contact with the liquid-jetting face of the liquid-jet head, wherein the cap member has such a size that the cap member comes into contact with a region in which the manifold is formed in the liquid-jet head.

5. A liquid-jet head comprising:

a plurality of individual passages communicating with nozzle orifices that jet liquid;

a manifold communicating with the plurality of individual passages, in which a surface of the manifold on the liquid jetting face side is sealed with a sealing member; and a rib provided in the manifold on the sealing member side which extends from the manifold to the sealing member in the liquid ejecting direction.

6. The liquid-jet head according to claim 5, wherein the sealing member is a nozzle plate in which the nozzle orifices are formed.

7. A liquid-jet apparatus comprising:

the liquid-jet head according to claim 5.

8. The liquid-jet apparatus according to claim 7, further comprising:

a cap member that comes into contact with the liquid-jetting face of the liquid-jet head, wherein the cap member has such a size that the cap member comes into contact with a region in which the manifold is formed in the liquid-jet head.

9. The liquid-jet head according to claim 5, wherein the sealing member is a nozzle plate in which the nozzle orifices are formed.

10. A liquid-jet head comprising:

a plurality of individual passages communicating with nozzle orifices that jet liquid;

a manifold communicating with the plurality of individual passages, in which a surface of the manifold on the liquid jetting face side is sealed with a sealing member; and a rib provided in the manifold on the sealing member side, wherein the rib is in contact with the sealing member.

11. A liquid-jet apparatus comprising:

the liquid-jet head according to claim 10.

12. The liquid-jet apparatus according to claim 11, further comprising:

a cap member that comes into contact with the liquid-jetting face of the liquid-jet head, wherein the cap member has such a size that the cap member comes into contact with a region in which the manifold is formed in the liquid-jet head.

* * * * *